US006942580B2

(12) United States Patent
Hou et al.

(10) Patent No.: US 6,942,580 B2
(45) Date of Patent: Sep. 13, 2005

(54) VIBRATION-ABSORBING PLATE FOR GOLF CLUB HEAD

(75) Inventors: Wen-Ching Hou, Kaohsiung (TW); Chan-Tung Chen, Kaohsiung (TW); Yu-Hong Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 0 days.

(21) Appl. No.: 10/779,669

(22) Filed: Feb. 18, 2004

(65) Prior Publication Data

US 2005/0181888 A1 Aug. 18, 2005

(51) Int. Cl.[7] ..... A63B 53/04; A63B 53/06
(52) U.S. Cl. ..... 473/332; 473/345; 473/350
(58) Field of Search ..... 473/324–350

(56) References Cited

U.S. PATENT DOCUMENTS 4,824,110 A * 4/1989 Kobayashi ..... 473/332
4,928,972 A * 5/1990 Nakanishi et al. ..... 473/332
5,547,194 A * 8/1996 Aizawa et al. ..... 473/350
5,697,855 A * 12/1997 Aizawa ..... 473/350
5,899,821 A * 5/1999 Hsu et al. ..... 473/332
5,967,903 A 10/1999 Cheng
6,030,295 A * 2/2000 Takeda ..... 473/345
6,045,465 A * 4/2000 Alfano et al. ..... 473/457
6,086,485 A * 7/2000 Hamada et al. ..... 473/329
6,364,789 B1 * 4/2002 Kosmatka ..... 473/329
6,743,117 B2 * 6/2004 Gilbert ..... 473/332

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

A golf club head includes a body having a cavity in a rear side thereof, a striking plate provided on a front side of the body, and a vibration-absorbing plate fixed in the cavity of the body and not in contact with the striking plate. The damping effect of the golf club head and gripping comfort are improved.

16 Claims, 8 Drawing Sheets

VIBRATION-ABSORBING PLATE FOR GOLF CLUB HEAD

BACKGROUND OF THE INVENTION

1. Field of the Invention

The present invention relates to a vibration-absorbing plate for a golf club head. In particular, the present invention relates to a vibration-absorbing plate for gaining damping effect of the body of the golf club head to thereby effectively absorb the vibrations generated as a result of striking a golf ball.

2. Description of Related Art

U.S. Pat. No. 5,967,903 discloses a golf club head with a sandwich structure and a method of making the same. As illustrated in FIG. 1 of the drawings which corresponds to FIG. 3 of U.S. Pat. No. 5,967,903, the golf club head includes a body 10, a striking assembly consisting of a front member 20 and a rear member 21. The body 10 is made of stainless steel or the like. Further, the body 10 includes a groove 17, a rear cavity 11, and an aperture 16 which connects the groove 17 to the rear cavity 11. The front member 20 and the rear member 21 are inserted via a front side of the body 10 into the groove 17 and fixed on a stepped portion 12 of the body 10. The front member 20 is formed from a relatively hard material (such as maraging steel, titanium alloy, etc.), and the rear member 21 is formed from a relatively soft material (such as aluminum, bronze, etc.). The rear member 21 damps impact generated vibrations, thereby improving gripping comfort and improving striking accuracy.

The rear member 21 and the front member 20 would elastically deform and reciprocatingly vibrate in a synchronous manner until completely stopped. However, according to dynamic analysis, the rear member 21 in a dynamic state contributed far less than the front member 20 in a static state did. Namely, the vibration-absorbing capacity of the golf club head largely depends on the damping value of the golf club head itself and has little concern with the composite structure consisting of the front member 20 and the rear member 21. Further, the rear member 21 tightly engaged to the rear side of the front member 20 restrains the elastic deformation of the front member 20. The striking effect of the front member 20 (i.e., the flying distance of a golf ball stricken by the front member 20) is adversely affected. Further, the front member 20 and the rear member 21 are formed of different materials and thus have different coefficients of elastic deformation. Thus, after striking golf balls for several times, deformation of the front member 20 would be different from that of the rear member 21. Consequently, the front member 20 and the rear member 21 are apt to disengage from each other. As a result, the front member 20 and the rear member 21 impact each other and thus generate odd sound while striking.

In a case that the front member 20 and the rear member 21 are bonded together by adhesive, the composite structure of front member 20/rear member 21 is not suitable for conventional welding procedures for engaging the composite structure with the body 10. Although the front member 20 and the rear member 21 can be tightly engaged together by explosive welding, the cost is largely increased. Further, the rear member 21 sandwiched between the step portion 12 of the body 10 and the front member 20 and formed from a relatively soft material is plastic and thus would plastically deform, adversely affecting the bonding reliability among the body 10, the front member 20, and the rear member 21. Undesired disengagement may occur, undesired gap and/or odd sound during striking may be generated, and what is worse, the front member 20 and the rear member 21 may be disengaged from the body 10.

OBJECTS OF THE INVENTION

An object of the present invention is to provide a vibration-absorbing plate for a golf club head to gain damping effect of the golf club head and to improve gripping comfort.

Another object of the present invention is to provide a vibration-absorbing plate for a golf club head to improve strength of the golf club head.

A further object of the present invention is to provide a vibration-absorbing plate for a golf club head to shift the center of gravity of the golf club head according to need.

Still another object of the present invention is to provide a vibration-absorbing plate for a golf club head to mitigate the need of strengthening the other portion of the golf club head.

Yet another object of the present invention is to provide a vibration-absorbing plate for a golf club head to mitigate the need of a weight member.

Still another object of the present invention is to provide a vibration-absorbing plate for a golf club head to cover unfinished area in a cavity in a rear side of the golf club head, thereby simplifying the processing procedure and cutting the processing cost.

SUMMARY OF THE INVENTION

In accordance with an aspect of the present invention, a golf club head comprises a body including a cavity in a rear side thereof, a striking plate provided on a front side of the body, and a vibration-absorbing plate fixed in the cavity of the body and not in contact with the striking plate. The damping effect of the golf club head is gained by the vibration-absorbing plate.

The cavity of the body may include a stepped portion for supporting and fixing the vibration-absorbing plate.

In an embodiment of the invention, the striking plate is integrally formed with the body.

In another embodiment of the invention, the body includes a recess in a front side thereof and an aperture that connects the recess to the cavity. The recess of the body includes a stepped portion for supporting and fixing the striking plate in the recess.

In a further embodiment of the invention, the vibration-absorbing plate includes a perimeter wall extending from a side thereof. The perimeter wall is engaged with an inner perimeter delimiting the cavity. Further, the perimeter wall of the vibration-absorbing plate abuts against an inner side of the stepped portion of the recess of the body.

The body may include an extension extending rearward from a bottom thereof. Further, the body may include a compartment in a bottom thereof for receiving a weight member.

In a modified embodiment of the invention, the vibration-absorbing plate includes an opening in a central portion thereof. In another modified embodiment of the invention, the vibration-absorbing plate includes a hole in a central portion thereof and a plurality of radial openings.

The vibration-absorbing plate is a light metal plate or a light alloy plate, wherein the light metal plate is formed from at least one of magnesium, aluminum, and titanium, and wherein the light alloy plate is formed from an alloy of at least one of magnesium, aluminum, and titanium.

The vibration-absorbing plate may be a plate formed by means of weaving one of graphite, titanium wires, and Kevlar fibers. Alternatively, the vibration-absorbing plate is a pre-pressed composite plate formed by means of mix-weaving at least two of graphite, titanium wires, titanium alloy wires, and Kevlar fibers.

Preferably, the golf club head is an iron club head.

Other objects, advantages and novel features of this invention will become more apparent from the following detailed description when taken in conjunction with the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
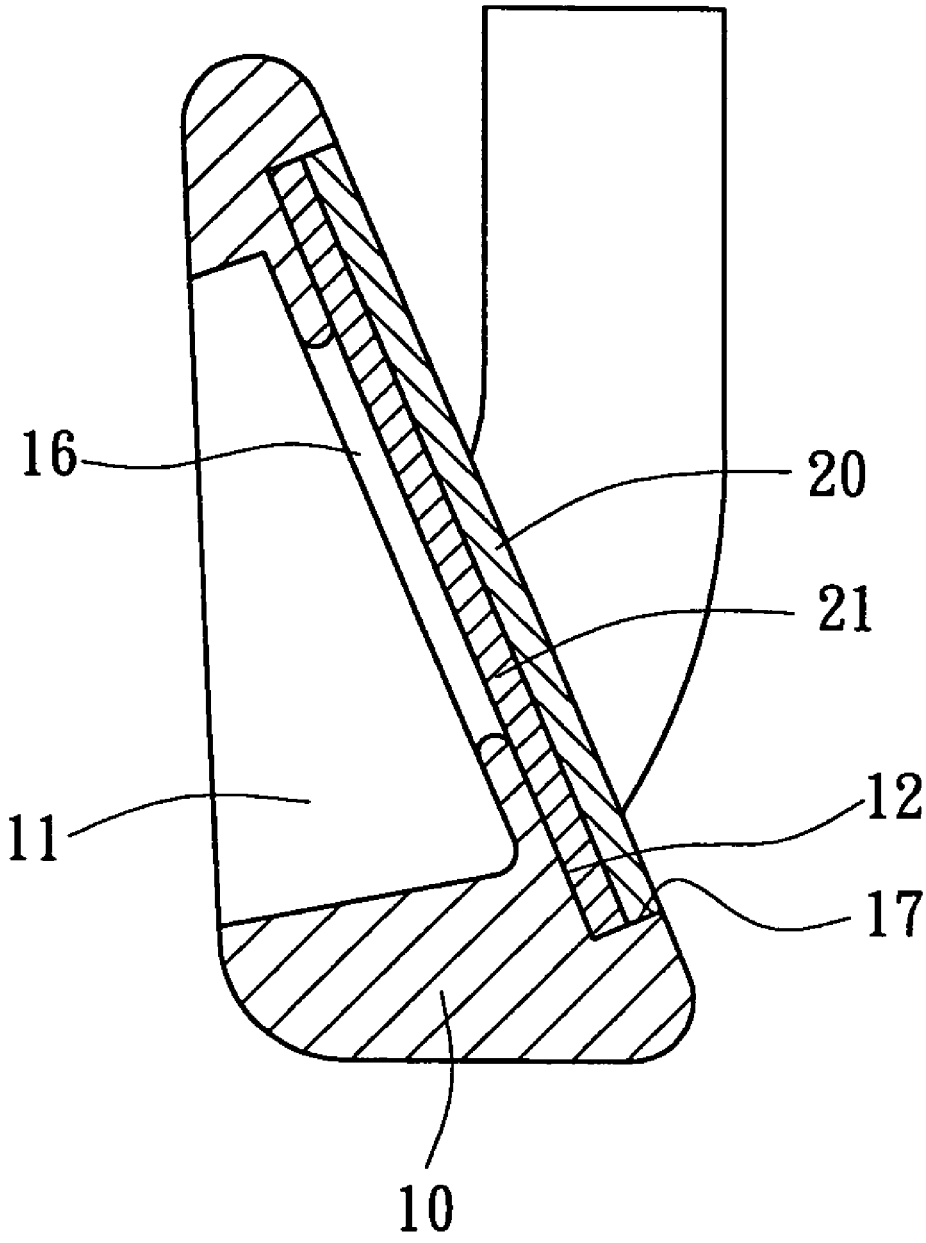
FIG. 1 PRIOR ART
FIG. 1 is a sectional view of a conventional golf club head.

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

Preferred embodiments of the present invention are now to be described hereinafter in detail, in which the same reference numerals are used in the preferred embodiments for the same parts as those in the prior art to avoid redundant description.

Figure 2:
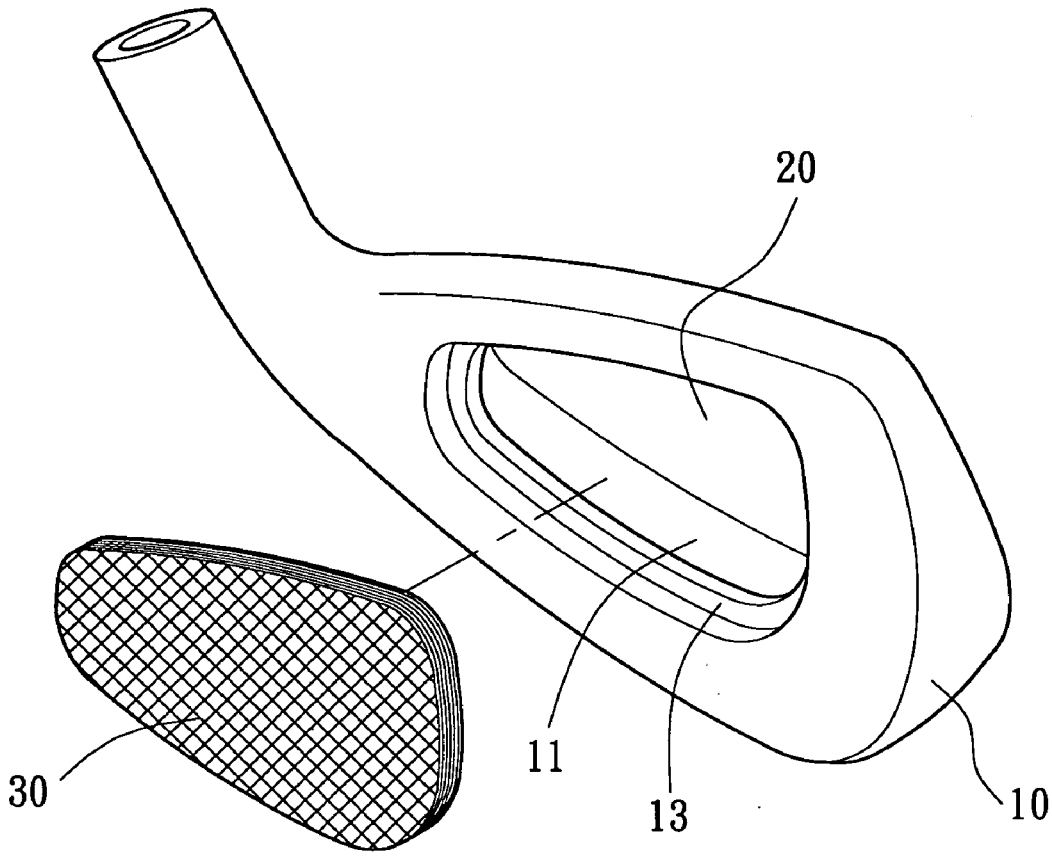
FIG. 2 is an exploded perspective view of a first embodiment of a golf club head in accordance with the present invention.
Figure 3:
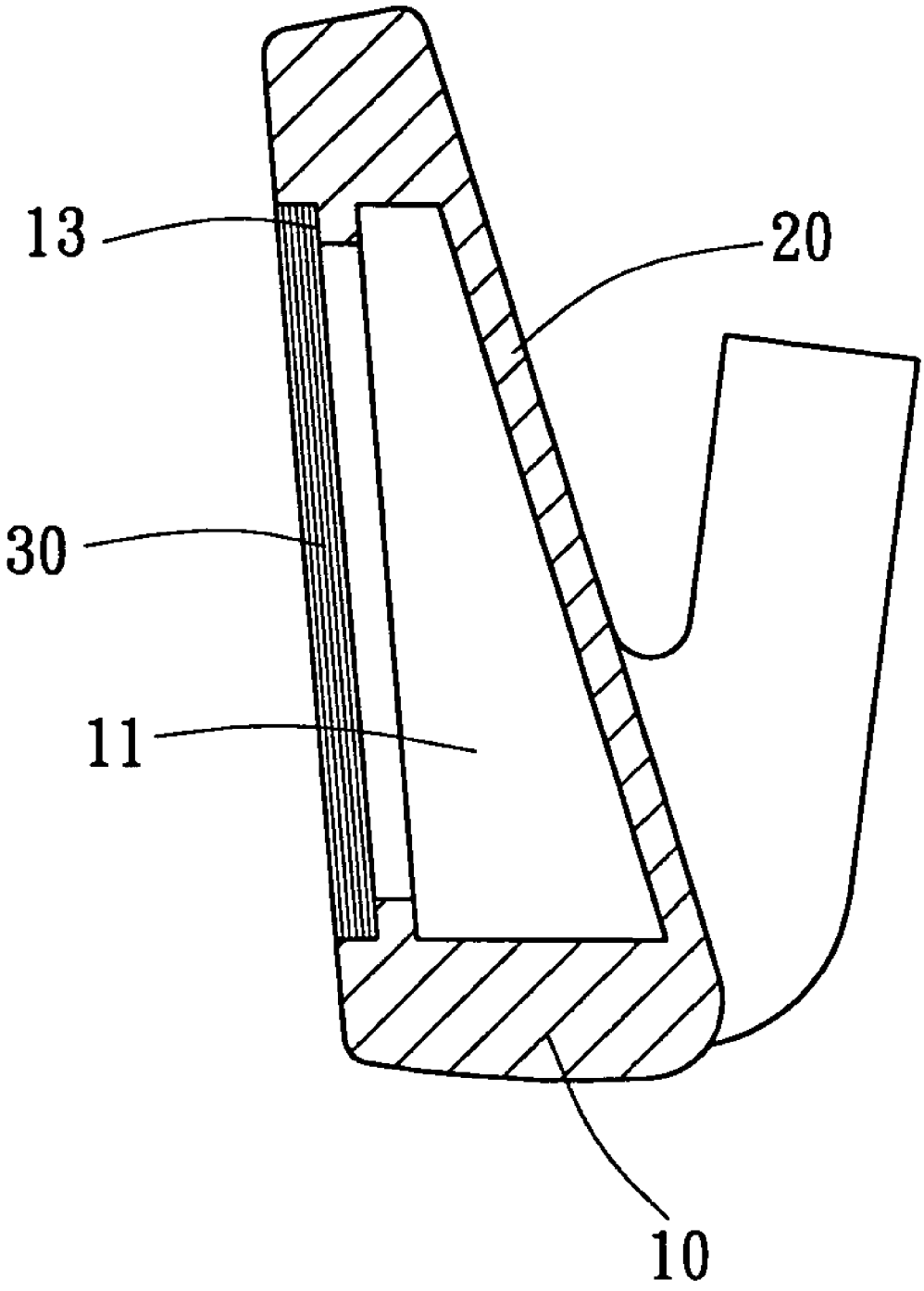
FIG. 3 is a sectional view of the golf club head in FIG. 2.

Referring to FIGS. 2 and 3, a first embodiment of a golf club head in accordance with the present invention comprises a body 10, a striking plate 20, and a vibration-absorbing plate 30. The body 10 and the striking plate 20 are integrally formed from stainless steel, titanium alloy, carbon steel, special steel, etc. The striking plate 20 forms a front side of the body 10. A cavity 11 is defined in a rear side of the body 10 and has a stepped portion 13. The vibration-absorbing plate 30 is preferably a carbon fiber plate formed by means of pre-pressing a uni-direction cloth, plain-woven cloth, or twill cloth of graphite. The vibration-absorbing plate 30 is fixed on the stepped portion 13 by, e.g., bonding. The adhesive for bonding the vibration-absorbing plate 30 to the stepped portion 13 is preferably epoxy resin. Alternatively, the adhesive can be of one of solvent-release type, pressure-sensitive type, heat-sensitive type, and chemically-reactive type.

As illustrated in FIG. 3, the vibration-absorbing plate 30 is fixed on the stepped portion 13 of the cavity 11 and seals the cavity 11 without in contact with the striking plate 20. Thus, the damping effect of the body 10 is gained (improved) by the vibration-absorbing plate 30, which improves the gripping comfort. Further, since the vibration-absorbing plate 30 is not in contact with the striking plate 20, the vibration-absorbing plate 30 is not affected by the elastic deformation of the striking plate 20 during striking, assuring the vibration-absorbing effect of the vibration-absorbing plate 30. Further, the vibration-absorbing plate 30 reliably supports an inner perimeter delimiting the cavity 11, strengthening the body 10 and mitigating the need of a weight member in other portion of the body 10 as well as mitigating the need of strengthening the other portion of the body 10. The center of gravity of the club head is shifted rearward or can be adjusted according to need. Further, since the cavity 11 is sealed by the vibration-absorbing plate 30, the unfinished areas inside the cavity 11 including molding lines or burrs can be covered by the vibration-absorbing plate 30, which reduces the finishing procedures, reduces the processing cost, and simplifies the processing procedure.

Alternatively, the vibration-absorbing plate 30 can be a light metal plate having a specific density smaller than 4.8 $g/cm^3$, a light alloy plate having a specific density smaller than 4.8 $g/cm^3$, a plate formed by means of weaving graphite, titanium wires (or titanium alloy wires), or Kevlar fibers, or a pre-pressed composite plate formed by means of mix-weaving at least two of graphite, titanium wires (or titanium alloy wires), and Kevlar fibers. The light metal plate is formed from at least one of magnesium, aluminum, and titanium. The light alloy plate is formed from an alloy of at least one of magnesium, aluminum, and titanium. The Kevlar fibers are poly-p-phenylene terephthalamide (PPTA) sold by Dupont Inc. under the name Kevlar®. By means of restraining the physical/mechanical properties of the vibration-absorbing plate 30, such as the specific density, tensile strength, tensile modulus, elongation, hardness (HV), and thickness, the center of gravity of the club head can be lowered and crisp sound can be generated when striking a golf ball. Further, since the graphite is black, the Kevlar fibers are golden, and the titanium wires are silver, by means of using the graphite, Kevlar fibers, or the titanium wires (or titanium alloy wires) or a combination thereof, the vibration-absorbing plate 30 may present various appearances of colorful patterns consisting of black lines, golden lines, and sliver lines. Thus, an aesthetically pleasing golf club head is provided, adding value to the golf club head.

Figure 4:
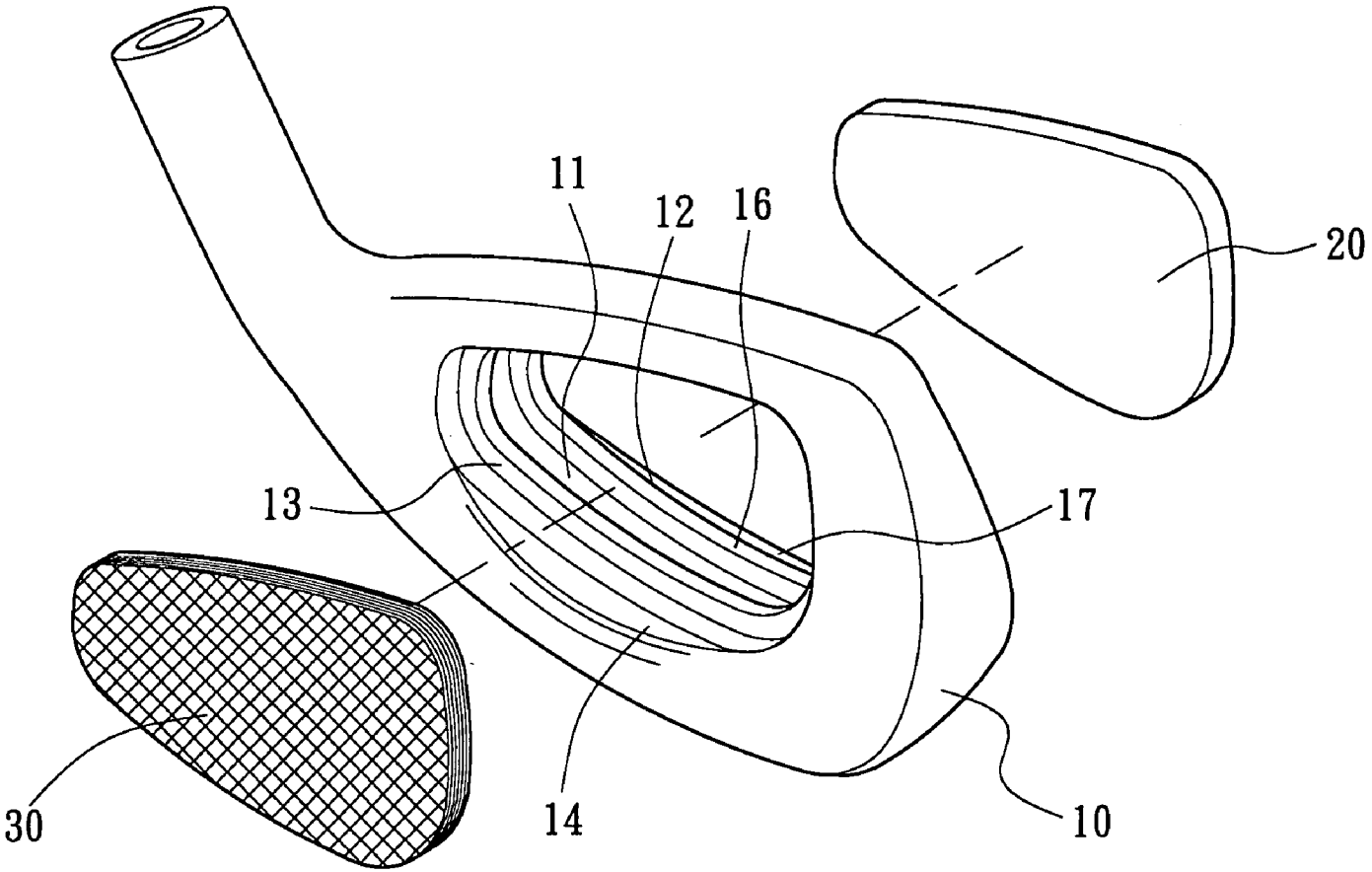
FIG. 4 is an exploded perspective view of a second embodiment of the golf club head in accordance with the present invention.
Figure 5:
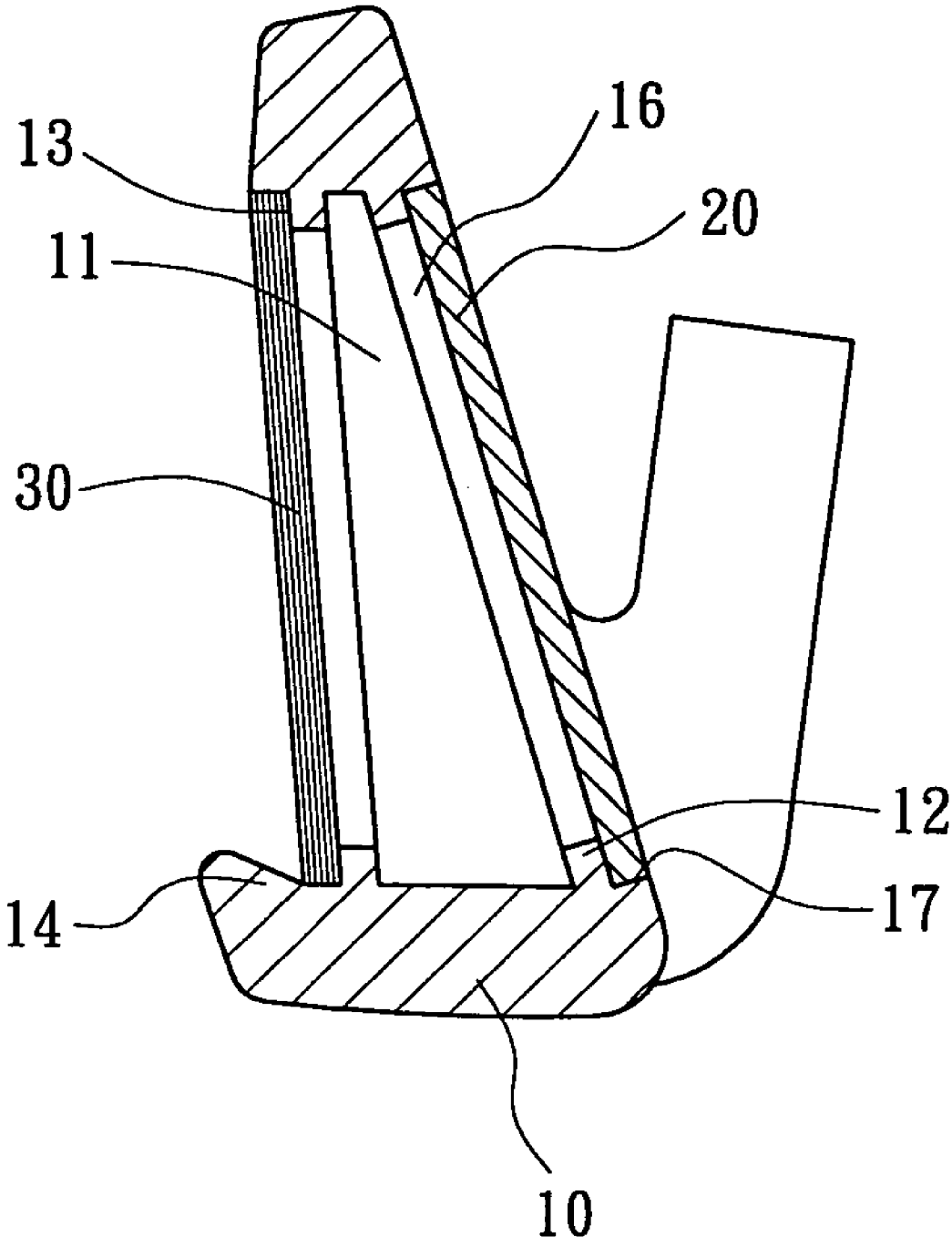
FIG. 5 is a sectional view of the golf club head in FIG. 4.

FIGS. 4 and 5 illustrate a second embodiment of the golf club head in accordance with the present invention. In this embodiment, the golf club head includes a body 10 and a striking plate 20 that are assembled together by an appropriate means and that are formed from different materials. The body 10 includes a recess 17 in a front side thereof, a cavity 11 in a rear side thereof, and an aperture 16 which connects the recess 17 to the cavity 11. The cavity 11 includes a stepped portion 13, and the recess 17 has a stepped portion 12.

The striking plate 20 is inserted into the recess 17 via the front side of the body 10 and supported by the stepped portion 12. The striking plate 20 can be fixed in the recess 17 of the body 10 by welding, bonding, insertion, or screwing. For example, the striking plate 20 and the body 10 can be engaged together by high-energy welding, such as laser welding, electric beam welding, plasma welding, or argon welding. The body 10 may further include an extension 14 extending rearward from a bottom thereof.

Similar to in the first embodiment, the vibration-absorbing plate 30 is fixed on the stepped portion 13 of the cavity 11 and supports an inner perimeter delimiting the cavity 11. Further, the vibration-absorbing plate 30 is not in contact with the striking plate 20 and seals the cavity 11. The damping effect of the golf club head is gained, the gripping comfort is improved, and the processing procedure is simplified. The center of gravity of the club head is further shifted rearward by the extension 14. The inertia moment is increased and the striking effect is improved (i.e., the flying distance of the golf ball stricken by the golf club head is increased). Further, since the cavity 11 is sealed by the vibration-absorbing plate 30, the unfinished areas inside the cavity can be covered by the vibration-absorbing plate 30.

Figure 6:
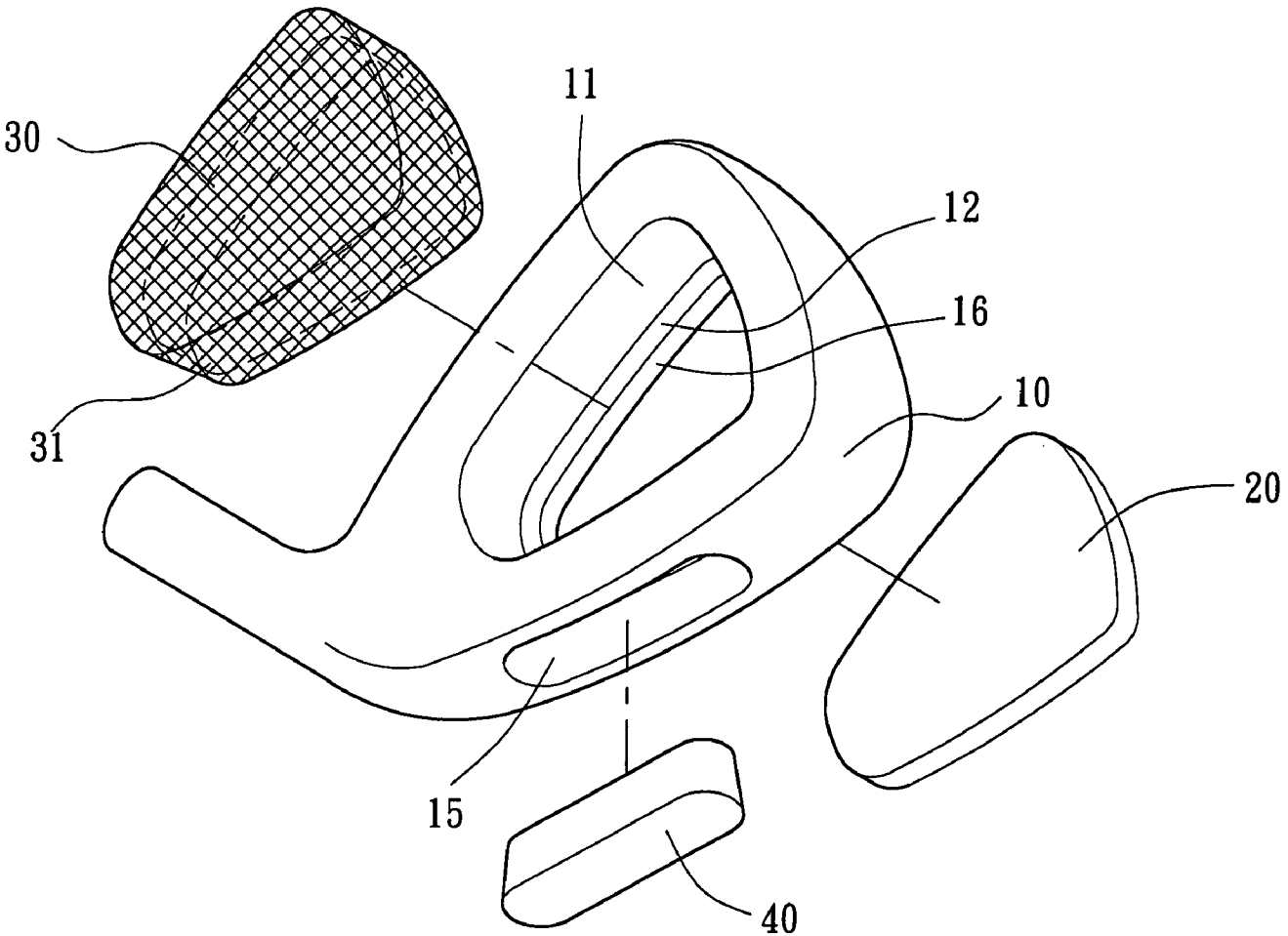
FIG. 6 is an exploded perspective view of a third embodiment of a golf club head in accordance with the present invention.
Figure 7:
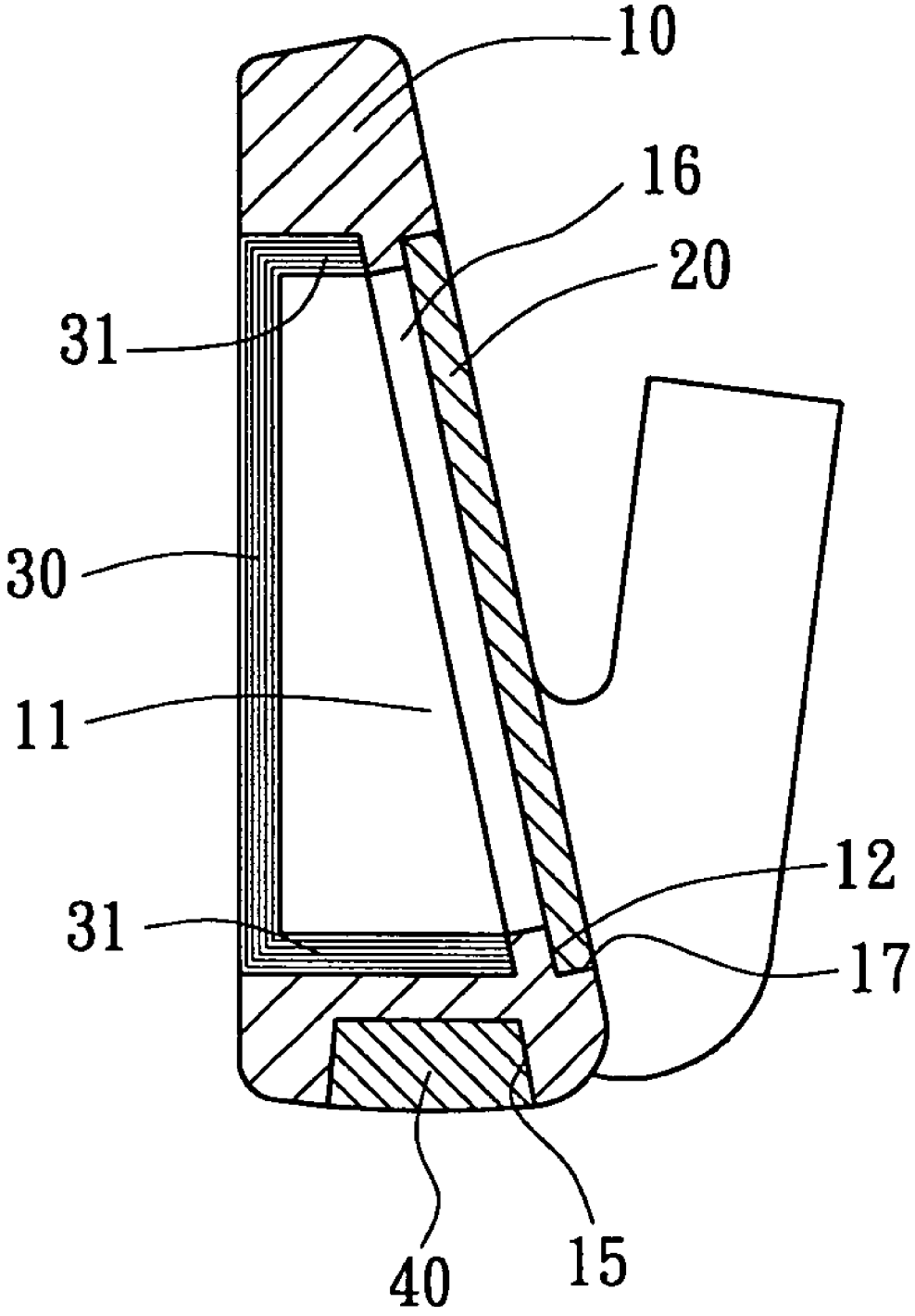
FIG. 7 is a sectional view of the golf club head in FIG. 6.

FIGS. 6 and 7 illustrate a third embodiment of the golf club head in accordance with the present invention. In this embodiment, the stepped portion 13 of the second embodiment is omitted, and the vibration-absorbing plate 30 includes a perimeter wall 31 extending from an inner side thereof. The vibration-absorbing plate 30 is suitable for an iron club head. The vibration-absorbing plate 30 can be formed by means of bending the perimeter of the vibration-absorbing plate 30. Further, a compartment 15 is defined in a bottom of the body 10 for receiving a weight member 40.

As illustrated in FIG. 7, an outer wall face of the perimeter wall 31 of the vibration-absorbing plate 30 can be bonded by glue to the inner perimeter delimiting the cavity 11, further increasing the bonding area and the vibration-absorbing area as well as improving the bonding strength. Further, the perimeter wall 31 of the vibration-absorbing plate 30 may abut against a rear side of the stepped portion 12, such that the vibrations of the striking plate 20 generated as a result of striking a golf ball can be directly transmitted to the vibration-absorbing plate 30 via the stepped portion 12 and the perimeter wall 31, further improving the vibration-absorbing effect.

Figure 8:
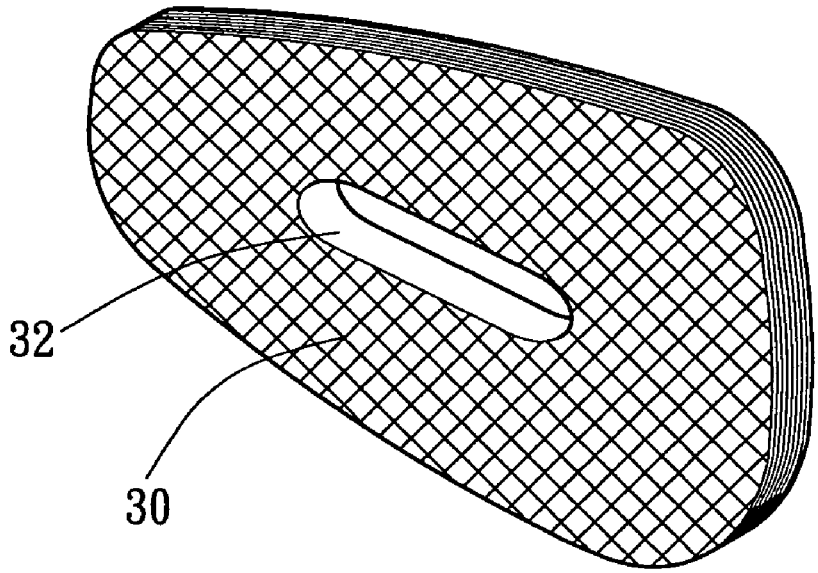
FIG. 8 is a perspective view illustrating a modified embodiment of a vibration-absorbing plate of the golf club head in accordance with the present invention.
Figure 9:
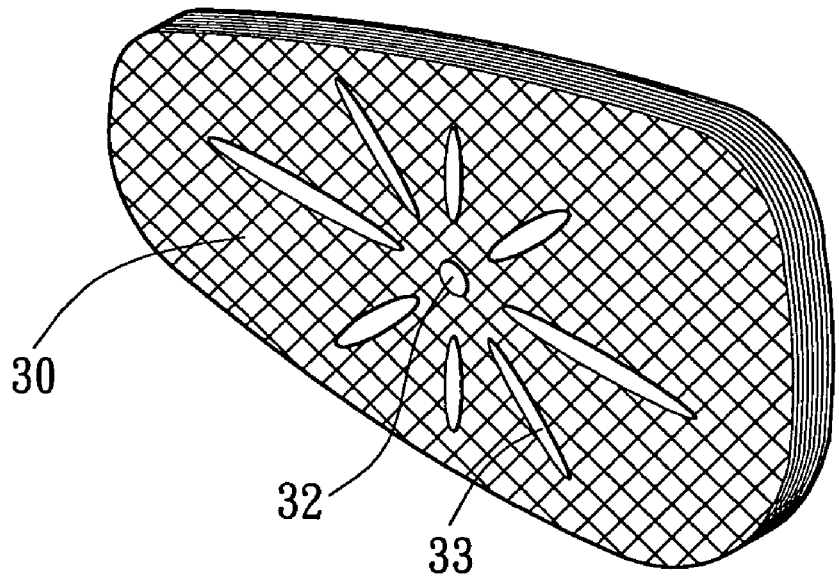
FIG. 9 is a perspective view illustrating another modified embodiment of the vibration-absorbing plate of the golf club head in accordance with the present invention.

FIG. 8 illustrates a modified embodiment of the vibration-absorbing plate 30 of the golf club head in accordance with the present invention. In a case that the cavity 11 is completely sealed by the vibration-absorbing plate 30, the air in the cavity 11 may be pressurized or depressurized in response to the elastic deformation of the striking plate 20 that causes reciprocal front/rear movements of the striking plate 20. Although the pressurization/depressurization effect is small, the vibration-absorbing plat 30 may be disengaged from the body 10 after long-term use. To solve this problem, the vibration-absorbing plate 30 includes an elongated opening 32 that is preferably in a central area thereof. The opening 32 allows air to move into and out of the cavity 11. FIG. 9 is a perspective view illustrating another modified embodiment of the vibration-absorbing plate 30 of the golf club head in accordance with the present invention. In this embodiment, the vibration-absorbing plate 30 includes a central hole 32 and a plurality of radial openings 33. The pressurization/depressurization effect is avoided without adversely affecting the bonding strength and the supporting strength. Further, the appearance of the golf club head is aesthetically pleasing.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head, comprising:

a body made of a first material and including a cavity in a rear side thereof;

a striking plate provided on a front side of the body; and a vibration-absorbing plate made of a second material relatively lighter than said first material of the body, and said vibration-absorbing plate fixed in the cavity of the body to directly absorb vibrations from the body and spaced apart from the striking plate to define a hollow chamber therebetween that said hollow chamber prevents from obstructing deformations of the striking plate to permit deformation of the striking plate while striking a golf ball, and said vibration-absorbing plate directly absorbs vibrations from the body, thereby the vibration-absorbing plate gaining a damping effect of the golf club head, the vibration-absorbing plate including a bent perimeter wall extending from a side thereof, the bent perimeter wall being engaged with an inner perimeter delimiting the cavity and said bent perimeter wall ensures said vibration-absorbing plate spaced apart from said striking plate after assembling.

2. The golf club head as claimed in claim 1, wherein the cavity of the body includes a stepped portion for supporting and fixing the vibration-absorbing plate.

3. The golf club head as claimed in claim 1, wherein the striking plate is integrally formed with the body.

4. The golf club head as claimed in claim 1, wherein the body includes a recess in a front side thereof and an aperture that connects the recess to the cavity, the recess of the body including a stepped portion for supporting and fixing the striking plate in the recess.

5. The golf club head as claimed in claim 1, wherein the bent perimeter wall of the vibration-absorbing plate abuts against an inner side of a stepped portion of a recess of the body.

6. The golf club head as claimed in claim 1, wherein the body includes an extension rearward from a bottom thereof.

7. The golf club head as claimed in claim 1, wherein the body includes a compartment in a bottom thereof for receiving a weight member.

8. The golf club head as claimed in claim 1, wherein the vibration-absorbing plate includes an opening in a central portion therefore.

9. The golf club head as claimed in claim 1, wherein the vibration-absorbing plate includes a hole in a central portion thereof and a plurality of radial openings.

10. The golf club head as claimed in claim 1, wherein the vibration-absorbing plate is one of a light metal plate and a light alloy plate.

11. The golf club head as claimed in claim 10, wherein the light metal plate is formed from at least one of magnesium, aluminum, and titanium.

12. The golf club head as claimed in claim 10, wherein the light alloy plate is formed from an alloy of at least one of magnesium, aluminum, and titanium.

13. The golf club head as claimed in claim 1, wherein the vibration-absorbing plate is one of a plate formed by means of weaving one graphite, titanium wires, and poly-p-phenylene terephthalamide.

14. The golf club head as claimed in claim 1, wherein the vibration-absorbing plate is one of a plate is a pre-pressed composite plate formed by means of mix-weaving at least two of graphite, titanium wires, titanium alloy wires, and poly-p-phenylene terephthalamide.

15. The golf club head as claimed in claim 1, wherein the golf club head is an iron club head.

16. The golf club head as claimed in claim 1, wherein the hollow chamber is empty.

* * * * *